United States Patent [19]

Korenyi

[11] Patent Number: 4,464,108

[45] Date of Patent: Aug. 7, 1984

[54] COMBUSTION APPARATUS

[76] Inventor: Donald Korenyi, 25 John St., Lynbrook, N.Y. 11563

[21] Appl. No.: 523,810

[22] Filed: Aug. 16, 1983

Related U.S. Application Data

[63] Continuation-in-part of Ser. No. 208,887, Nov. 21, 1980, abandoned.

[51] Int. Cl.[3] ..... F23Q 3/00

[52] U.S. Cl. ..... 431/265; 431/183; 431/351; 239/402

[58] Field of Search ..... 431/265, 351, 183, 185; 239/402

[56] References Cited

U.S. PATENT DOCUMENTS

| | | | |
|---|---|---|---|
| 1,235,855 | 8/1917 | Stillman | 239/402 |
| 2,497,480 | 2/1950 | Walshin | 239/402 |
| 2,531,027 | 11/1950 | Carroll | 431/265 |
| 2,647,568 | 8/1953 | Sloan | 431/183 |
| 4,082,495 | 4/1978 | Lefebvre | 431/183 |

*Primary Examiner*—Carroll B. Dority, Jr.
*Attorney, Agent, or Firm*—Paul J. Sutton

[57] ABSTRACT

In a combustion apparatus having an ignition means, a plurality of first swirl vanes positioned at the upstream end of a flame retention head creates a helical primary air/fuel mixture in the combustion chamber of the retention head that ignites into a primary flame vortex. A second plurality of vanes mounted on the inner walls of the retention head shears the outer portions of the primary flame vortex into a plurality of secondary helical flame vortexes disposed about the perimeter of the primary flame vortex. The secondary flame vortexes are opposite in rotational orientation to the direction of rotation of the primary flame vortex. Secondary air is injected into the combustion chamber at the area of shearing.

18 Claims, 19 Drawing Figures

FIG. 1
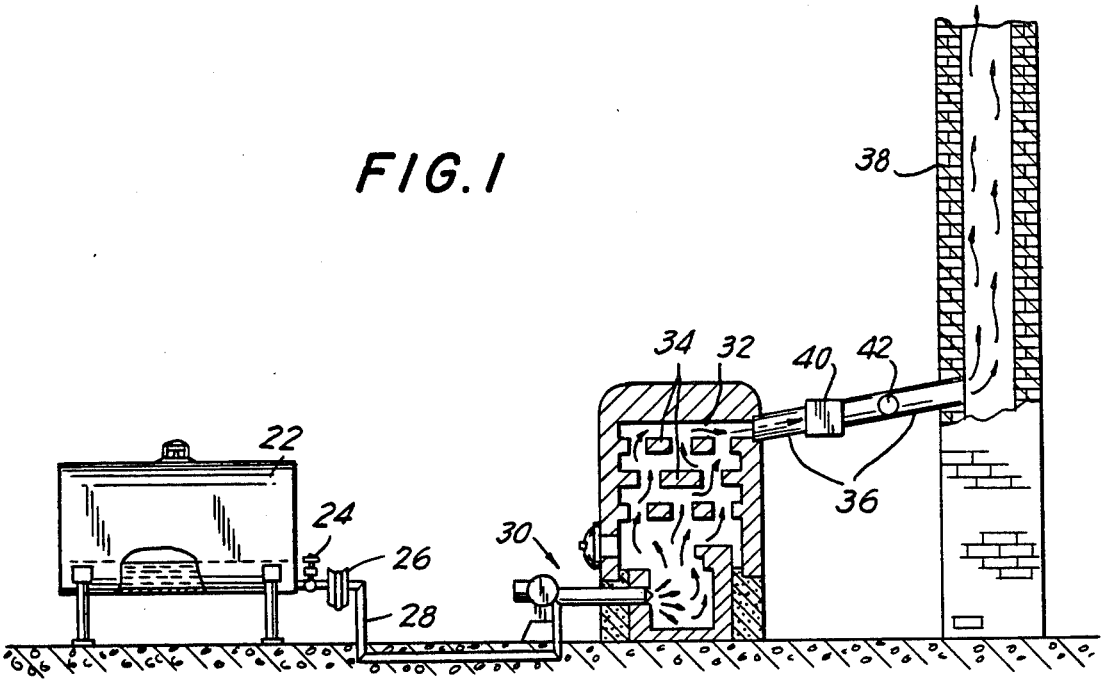
FIG. 2
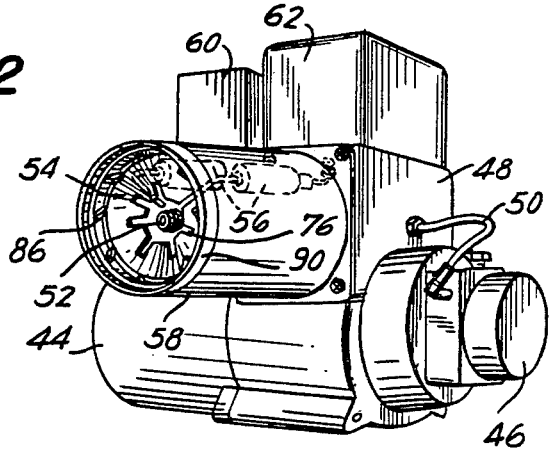
FIG. 5
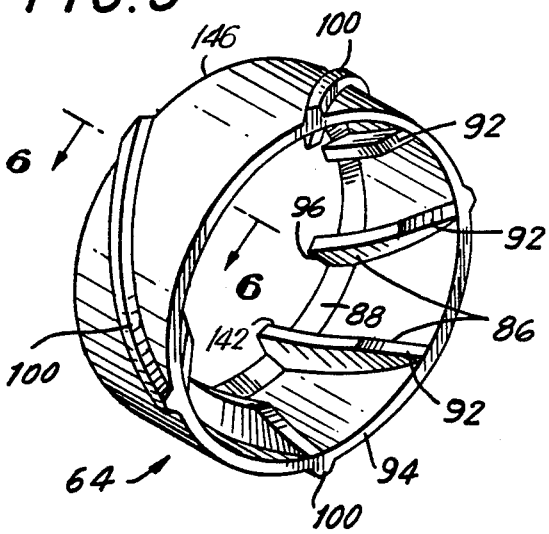
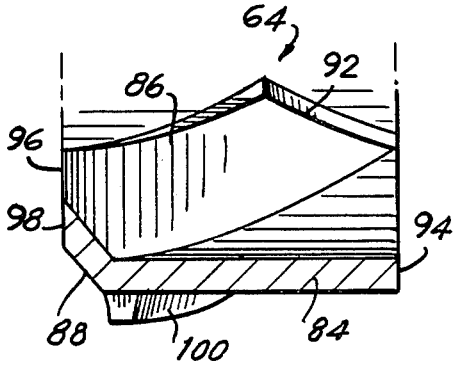
FIG. 6

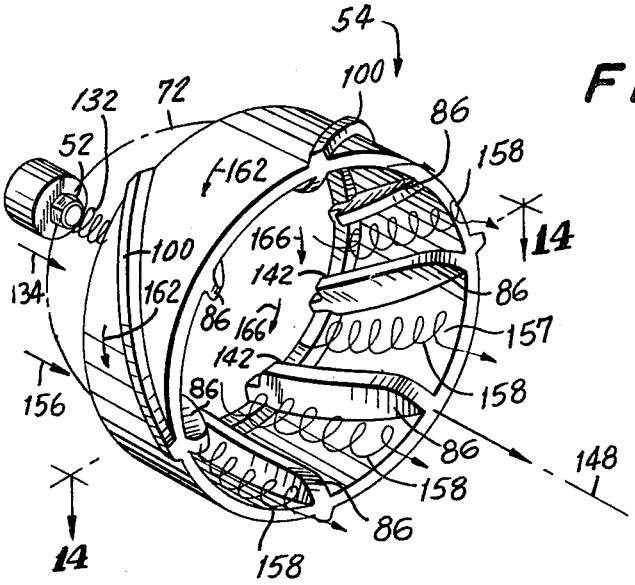
FIG. 13
FIG. 14
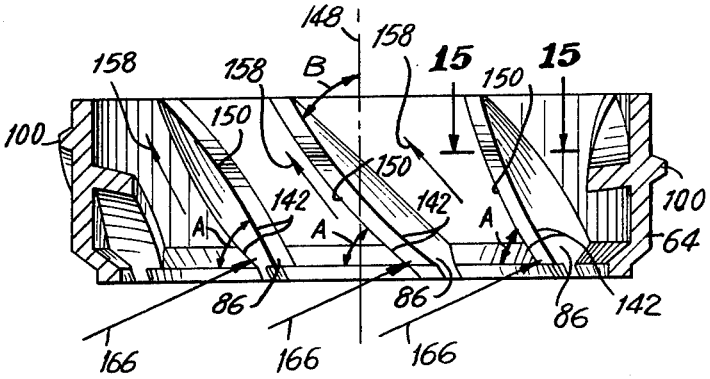
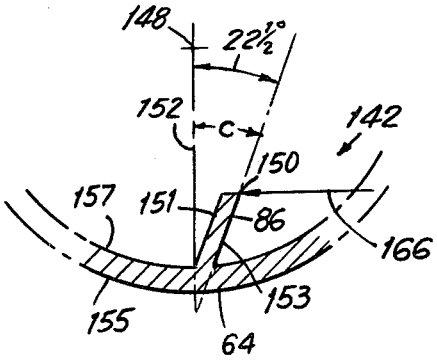
FIG. 15

COMBUSTION APPARATUS

This application is a continuation in part of an application filed Nov. 21, 1980, Ser. No. 208,887, now abandoned.

This invention relates generally to combustion apparatus and, more particularly, to combustion apparatus of the type used in domestic and commercial oil burners Hot air furnaces or oil burners are commonly used to heat home, offices and buildings in general. These units usually have a maximum rating of 1,000,000 BTU per hour. Among their many advantages are cleanliness, ease of handling, minimum labor requirements and simple controls that are automatic. The flame produced in present day oil burners results from the combustion of heavy fuel oil. The flame has heat radiation characteristics that are superior to industrial, gaseous fuels. Thus, there is a relatively efficient heat transfer. Also, fuel quantity and flame quality are easily controlled.

One common form of oil burner that is presently quite popular includes a drive motor for a fuel pump and a blower wheel. The drive motor may be of the continuous duty, split phase type. The fuel pump is normally designed to deliver fuel oil at a controlled pressure to an atomizing nozzle. Usually, a pressure regulating valve is provided. The air blower is designed to provide combustion air under high static pressure to the nozzle. High voltage electrodes having their tips adjacent to the discharge end of the nozzle are utilized for igniting the fuel air mixture that emanates from the nozzle.

In order to save fuel by increasing combustion efficiency, a flame retention head is provided immediately downstream of the fuel nozzle. The flame retention head includes a dome-like portion having a central hole therethrough for receiving the discharge end of the nozzle. A plurality of slots are formed in the domed portion of the flame retention head and swirl blades are formed integrally therewith so that the fuel/air mixture passing thereover is constrained along a helical, substantially central path.

Vibration caused by sound waves of burning fuel is a problem with jet flames that are associated with jet turbine engines. This vibration is caused by the turbulence in the burning flame jet or vortex. Vibration results in two problems.

The first problem is noise, which can make use of a jet engine unusable or requires expensive and inefficient insulation. The second problem with vibration is that the sound waves can actually eventually destroy the blades ot the jet turbine.

Another problem of jet flames is that the outer periphery of the jet flame are considerably cooler than the interior of the flame. This results in inefficient burning at the outer portions and additionally results in a flame retention head that is too cool to preheat incoming air that is injected as a cleaning mixture to increase burning efficiency. As a result, the air must be preheated before injection.

The present invention provides means for improving the efficiency of combustion apparatus of the type just described. However, it should be noted that the present invention is not necessarily limited to this specific type of combustion apparatus.

Accordingly, it is an object of the present invention to provide improved combustion apparatus.

Another object of the present invention is to provide improved combustion apparatus, as described above, wherein greater efficiency is achieved.

Yet another object of the present invention is to provide apparatus that will generate a higher level of heat at initial fire-up than will prior art devices.

A further object of the present invention is to provide apparatus that will assure maximum burning close to the discharge end thereof and away from the wall of the combustion chamber associated therewith.

Still another object of the invention is to provide improved combustion apparatus, as described above, that more completely burns the fuel being employed.

Another object of the present invention is to provide an improved combustion apparatus, as described above, that burns fuel with more B.T.U.'s.

It is yet another object of the present invention to create a plurality of secondary flame vortexes about a primary flame vortex to increase burning efficiency at the walls of the flame retention head so that the retention head can be used to preheat incoming air, both primary air, secondary air, and tertiary air.

It is yet another object of the present invention to create a plurality of secondary flame vortexes about a primary flame vortex so that the secondary vortexes will absorb the sound waves of the primary flame vortex, thus reducing overall noise.

A further object of the present invention is to provide an improved combustion apparatus, as described above, that requires a minimum of modification to existing apparatus.

Still another object of the present invention is to provide improved combustion apparatus, as described above, that may be inexpensivley installed.

These and other objects, features and advantages of the invention will, in part, be pointed with particularity and will, in part, become obvious from the following more detailed description of the invention, taken in conjunction with the accompanying drawing which forms an integral part thereof.

In its broadest aspect, the present invention provides deflector means that include a plurality of internal swirl vane means which are positioned immediately downstream of the swirl vanes that are integral with the flame retention head. The internal swirl vane means that form a part of the deflector means are intended to separate the helically flowing, centrally located fuel/air mixture that is being discharged from the nozzle area into a plurality of discrete and separate flow paths that are opposite in angular orientation to the flow path of the material that is discharged from and about the central, atomizing nozzle. In effect, the plurality of flow paths are, in combination, in the form of a ring.

In one embodiment of the present invention the deflector means is in the form of an elongated sleeve and swirl vanes are formed on the inside surface thereof. The internal, deflector swirl vanes extend radially inwardly and axially between the ends of the elongated sleeve. The downstream end of each of the swirl vane blades may be positioned either at an angle with respect to a plane transverse the longitudinal axis of the sleeve or in a transverse plane that coincides with the end of the sleeve. Alternatively, only a radially inner portion of the end of each blade may be formed at an angle with respect to a plane transverse the longitudinal axis of the sleeve with the remainder of each blade being positioned in a plane that is coincidental with the end of the sleeve and transverse the longitudinal axis thereof.

The sleeve comprising the deflector means of the present invention may further be provided with blade-like swirl vane means on the outer surface thereof. The external swirl vane blades are positioned downstream of and in fluid communication with the additional air passage means formed proximate the periphery of the flame retention head. These external swirl vane blades are formed at an angle with respect to the longitudinal axis of the sleeve with the angle in oneembodiment of the invention being in the same direction as the angle of the internal swirl vane means. In a modified embodiment of the present invention the external swirl vane means are positioned at an angle with respect to the longitudinal axis of the sleeve that is opposite to the angle at which the internal swirl means are positioned.

After the fuel is discharged from the nozzle it is heated and atomized. A first portion of the fuel will become gaseous and another, heavier portion will liquefy. The lighter portion of the fuel, which is in the center and which is gaseous will burn utilizing primary air that flows about the nozzle. This will heat the heavier outer portion of the fuel which is thrown radially outwardly by the swirl vanes in the dome like part of the fuel retention head. A plurality of discrete and separate flow paths that are each substantially circular and reverse in their direction of rotation are formed by the vane blades.

Because the adjacent flow paths rotate in opposite directions they will act on each other in much the same manner as meshing gears. In addition, they will be impinged upon by the relatively cool, secondary air flow that is discharged through the base wall of the fuel retention head and which is directed along an annular, helical path by the secondary swirl vanes on the sleeve-like deflector means. The ring of oppositely rotating, substantially separate flow paths is, thus, contained by the secondary air flow which is heated thereby in order to preclude the burning fuel from contacting the wall of the fire-box or combustion chamber.

The swirl vanes on the outside surface of the sleeve-like deflector means utilize a ring of tertiary air that also passes through the base wall of the fuel retention head but at a location that is radially outward of the secondary air. The deflector means is made of a metal having good heat conducting characteristics whereby the tertiary air may be heated by means of the external swirl vanes. When the internal deflector means swirl vanes have a clockwise orientation and the external deflector means swirl vanes have a counterclockwise orientation, there will be tendency to move the burning mass of fuel and air in an axial direction away from the nozzle to thereby minimize the likelihood of the flame contacting the relatively cool fire-box wall and turning to carbon. When the internal and external swirl vanes of the deflector means have the same orientation, there will be a tendency to disrupt the burning mass and retard the axial movement thereof.

My invention will be more clearly understood from the following description of specific embodiments of the invention together with the accompanying drawings, wherein similar reference characters denote similar elements throughout the several views, and in which:

FIG. 1 is a fragmentary, partially sectional view schematically illustrating the enviornment of the present invention;

FIG. 2 is a perspective view illustrating an oil burner of the type that may utilize the present invention;

FIG. 5 is a perspective view of one embodiment of the deflector means comprising the present invention;

FIG. 6 is a fragmentary sectional elevational view taken along line 6—6 of FIG. 5;

Figure 12:
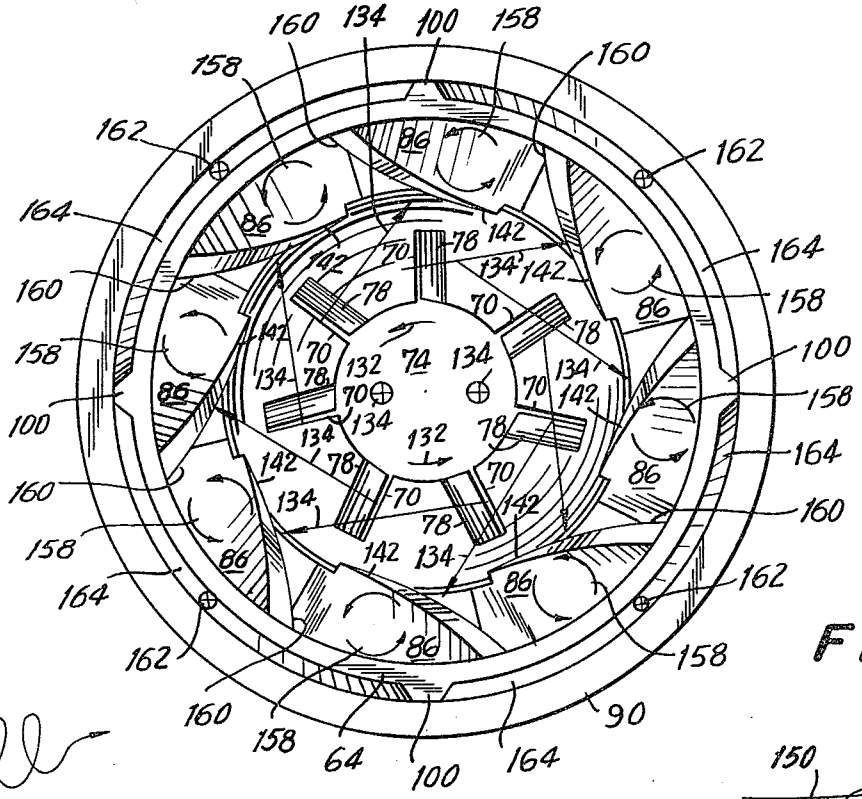
FIG. 12 is a view of the interior of the combustion chamber from upstream looking downstream and schematically illustrating the primary, secondary, and tertiary air flows along with the secondary flame vortexes.
Figure 12B:
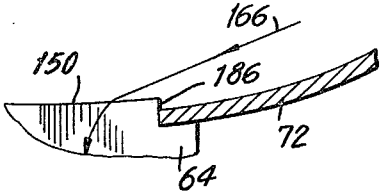
Figure 12A:
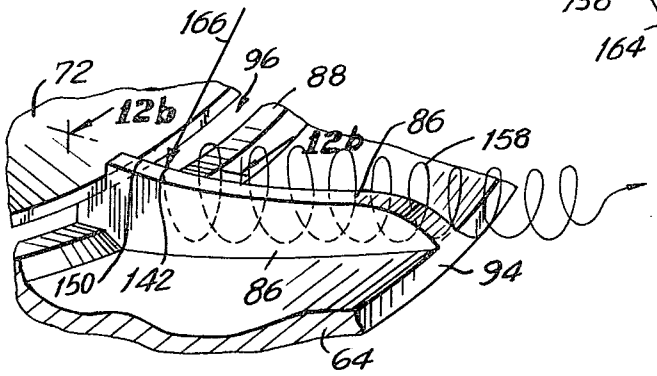

FIG. **12*a*** is an isolated, fragmentary, perspective view showing a cutting edge of a blade;

FIG. **12*b* is a view taken through line 12*b*—12*b* of FIG. 12*a*;**

Figure 16:
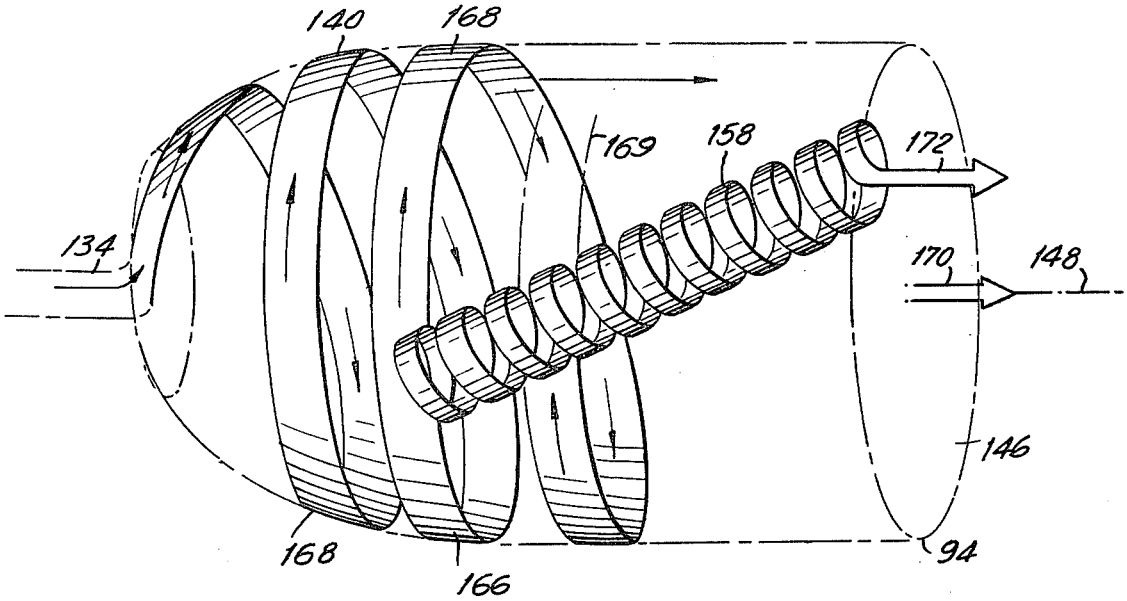
Figure 17:
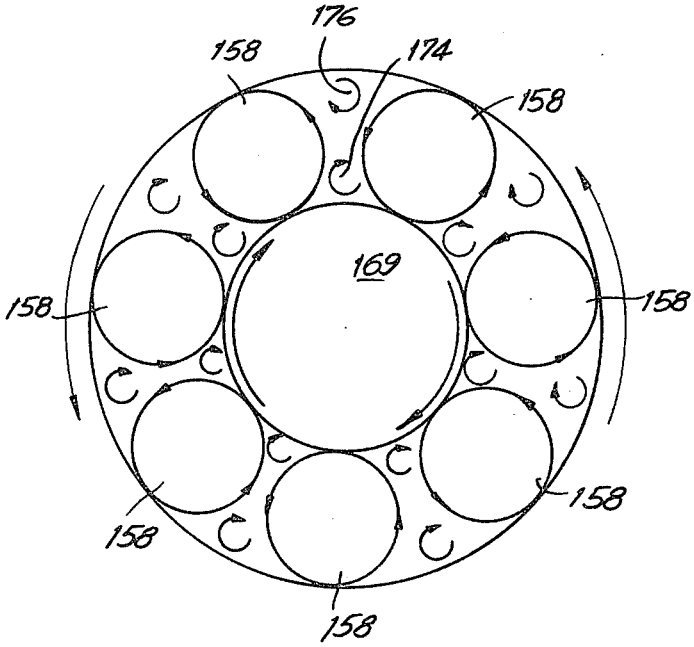

FIG. 13 is a perspective view of an embodiment of the present invention analagous to the embodiment shown in FIG. 5 and schematically indicating same secondary flame vortexes;

FIG. 14 is a view taken through line 14—14 of FIG. 13;

FIG. 15 is a view taken through line 15—15 of FIG. 14;

FIG. 16 is a schematic perspective view of the primary flame vortex along with one of the several secondary flame vortexes; and FIG. 17 is a schematic view taken from downstream of the primary flame vortex with the surrounding secondary vortexes showing the relative rotational movements.

Reference is now made in detail to the drawings. FIG. 1 illustrates a heating system 20 that may comprise an enviornment of the present invention. The heating system 20 includes an oil storage tank 22 having an outlet valve 24 that communicates with a filter 26. A suitable length of pipe 28 is used to deliver the fuel oil in the tank 22 to an oil burner 30 comprising the present invention.

After ignition of the fuel/air mixture that is discharged from the oil burner 30, the heat of combustion is directed into a combustion chamber 32 having baffle means 34 therein. The ducts for distributing the resulting heat to the building are not shown since they are conventional. Duct 36 provides communication between the combustion chamber 32 and a chimney 38. In a conventional manner a stack control 40 and a draft regulator 42 are also provided in the duct between the combustion chamber 32 and the chimney 38.

The oil burner 30 comprising the present invention is shown in somewhat greater detail in FIG. 2. The oil burner 30 comprises a motor 44 that drives a fuel pump 46 and an air blower 48. As is well known, an oil line 50 provides fuel under pressure to an atomizing nozzle 52 about which air under pressure is provided from the blower 48. The oil burner 30 further includes apparatus such as a flame retention head 54 or structure similar thereto and electrode means 56, all of which are contained within a blast tube 58. In a conventional manner, control means 60 and an ignition transformer 62 are also included.

Figure 3:
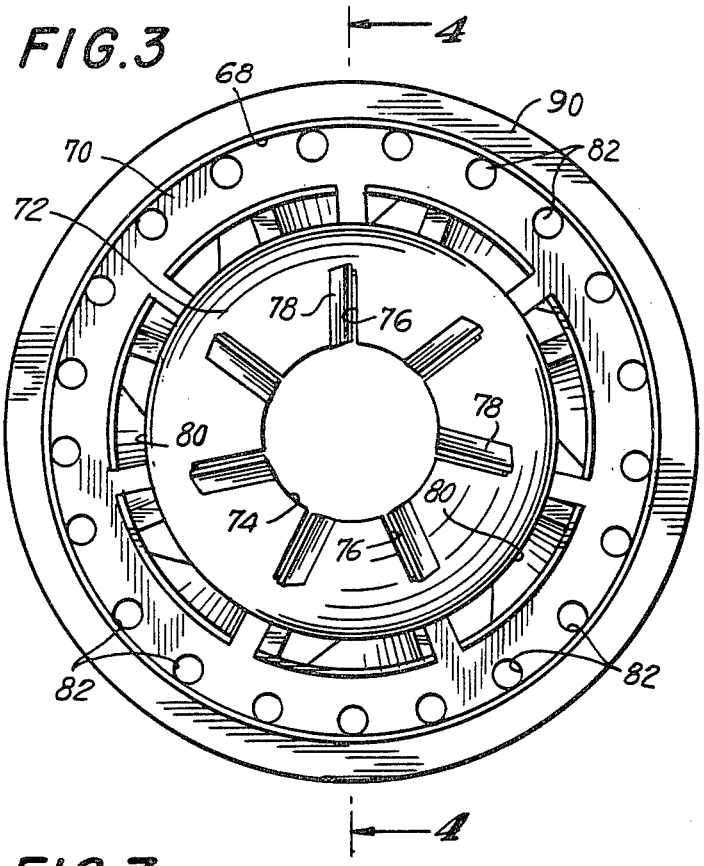
FIG. 3 is an end elevational view taken from the rear or inner end of the fuel retention head shown in FIG. 2 and with the structure comprising the present invention in place but with the atomizing nozzle omitted for purposes of clarity.
Figure 4:
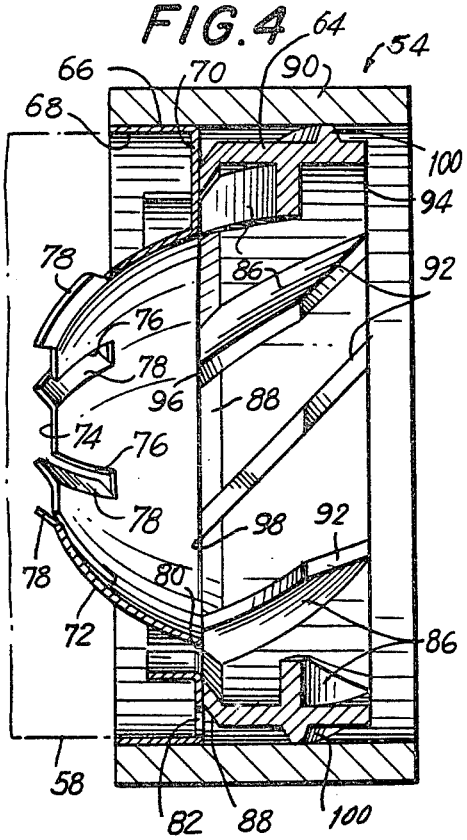
FIG. 4 is a sectional elevational view taken along line 4—4 of FIG. 3 with a portion of the oil burner shown in FIG. 2 being illustrated in phantom outline.

The structure of flame retention head 54 comprising the present invention is best shown in FIG. 3 and in FIG. 4. Flame retention head 54 is made of a suitable sheet metal material and includes cup-shaped peripheral circular mounting member 66 which has its open end facing in a direction towards the discharge end of the nozzle 52 and includes a side wall 68, the inner surface of which is sized so as to engage and be retained by the blast tube 58 in any suitable manner. A basewall 70 extends radially inwardly from a side wall 68 and is joined at its innermost end to a dome member 72 that defines the second, inner, cup-shaped member. Dome member 72 is provided with a relatively large, central, primary air opening 74 which distributes the primary air under pressure about the nozzle 52 and from which a plurality of slots 76 extend in a generally radial direction. The slots 76 are each formed by a tab that defines the first plurality of swirl vanes 78.

As mentioned hereinbefore, the radially inner of the basewall 70 of mounting portion 66 terminates at the base of dome member 72. It will be seen in FIGS. 3 and 4 that this juncture is not continuous around the periphery of the dome but instead is interrupted by a plurality of arcuate slots 80 that define the second air passage means of the flame retention head 54. A third plurality of air passage means 82 in the form of a series of holes extending through base wall 70 is also provided in flame retention head 54. For purposes to be detailed herinafter, third air passage means 82 are formed at the radially outer end of base wall 70 proximate the juncture thereof with side wall 68 that defines the circular mounting portion 66.

Flame retention head 54 may be made of any suitable metal having good heat conducting properties and is conventionally cast. Deflector tube 64 is in the form of an elongated, axial sleeve having a plurality of blades 86 formed on the inside surface thereof at an angle with respect to the longitudinal axis of tube 64. The end of the tube 64 that is closer to the nozzle 52 is beveled such as designated by the reference character 88 so that this end may rest against the base wall 70 of the flame retention head 54 without obstructing the third air passage means 82. Similarly, the air passage means 80 are also unobstructed by the radially inner end of the bevel 88 as shown in the lower hold of FIG. 4. In this manner, pressurized air to the second and third air passage means 80 and 82, respectively, and then to both the interior and the exterior of the deflector tube 64, respectively, is substantially unobstructed.

Deflector tube 64 is coupled to dome portion 72 and thus to blast tube 58 in any suitable manner. One such form of coupling is shown in FIGS. 3 and 4 and is seen to comprise a tubular sleeve member 90 which, because of its environment, is preferably manufactured from a suitable metal. Fasteners such as screws or the like may be employed to provide a structure that can be readily disassembled for servicing or replacement when required.

Several embodiments of the flame retention head comprising the present invention will now be described. For purposes of explanation, the first embodiment of flame retention head 54 is shown in FIGS. 5 and 6. It will be seen therein that the downstream end 92 of the blades 86 terminates at its radially outer end at the transverse downstream end face 94 of the deflector means 64. The entire end 92 of the blade 86 in this first embodiment is positioned at an angle with respect to the transverse end plane 94. The opposite end 96 of the blade 86 terminates at the transverse upstream end 98 of the deflector tube 64. In this first embodiment a third set of swirl vanes 100 are formed on the outside surface of tube 64. The swirl vanes 100 extend in a radially outward direction between the ends 94 and 98 of tube 64 and are positioned at an angle, with respect to the longitudinal axis of the tube 64, that is opposite to the angle at which the blades 86 are positioned, also with respect to the longitudinal axis of the tube 64.

Figure 7:
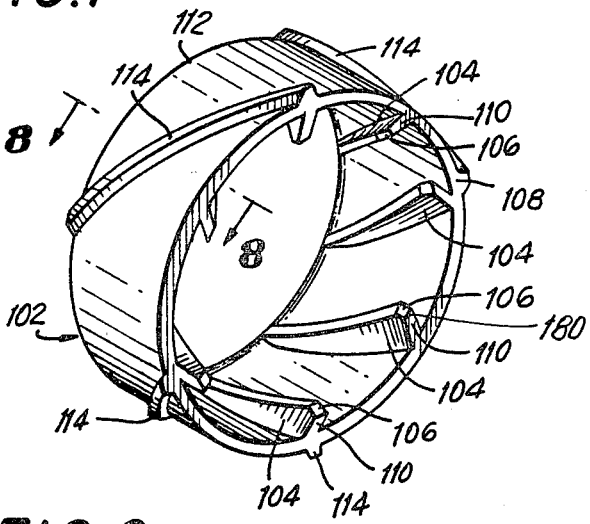
FIG. 7 is a perspective view of an alternative embodiment of the deflector means comprising the present invention.
Figure 8:
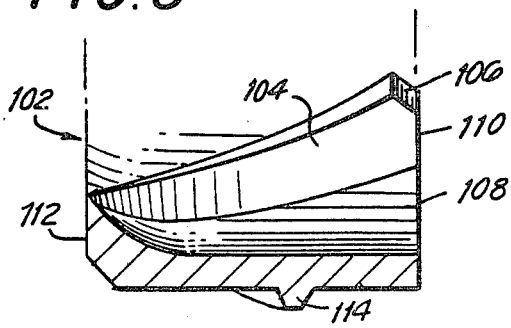
FIG. 8 is a fragmentary sectional view taken along line 8—8 of FIG. 7.

An alternative embodiment of flame retention head 54 is shown in FIGS. 7 and 8 and is illustrated by the deflector tube 102. This second embodiment, which is also made of a heat conductive metal differs from the first embodiment in several respects. First of all a plurality of blades 104 are each provided with a radially inner, downstream end portion 106 that is positioned at an angle with respect to the transverse plane of the end surface 108. The remaining portion 110 of the end of each of blades 104 is positioned in the same transverse plane of the end surface 108. A second distinction of the embodiment shown in FIGS. 7 and 8 over that shown in FIGS. 5 and 6 resides in the fact that blades 104 taper outwardly from a radially inner positon to the inside surface of the deflector tube 102 from the downstream end 108 to the upstream end 112 thereof. Finally, it will be seen that the swirl vanes 114 formed on the outer surface of deflector tube 102 are positioned at the same angle as swirl vanes 104 formed on the inner surface, both with respect to the longitudinal axis of deflector tube 102.

Figure 9:
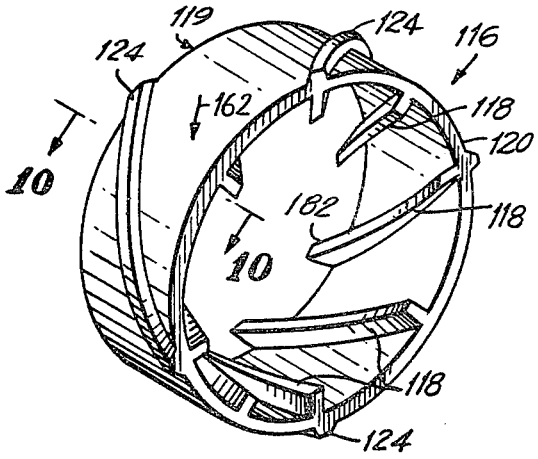
FIG. 9 is a perspective view of still another alternative embodiment of the deflector means comprising the present invention.
Figure 10:
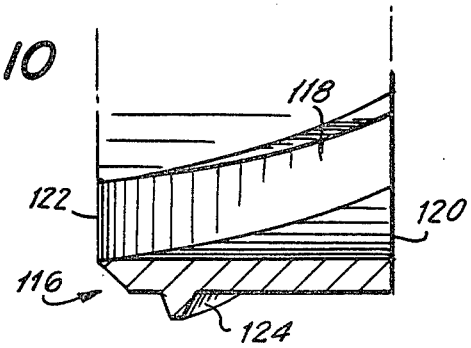
FIG. 10 is a fragmentary sectional view taken along line 10—10 of FIG. 9.

A third embodiment of flame retention head 54 is shown in FIGS. 9 and 10. It will be seen therein that a deflector tube 116 which is made of a metal having good heat conducting characteristics is provided with a plurality of blades 118 the downstream ends of which are coincidental with and in the same transverse plane as the end surface 120 of deflector tube 116. In a manner similar to the first embodiment shown in FIGS. 5 and 6, but different than the second embodiment shown in FIGS. 7 and 8, blades 118 in the third embodiment shown in FIGS. 9 and 10 are uniform in height with respect to the inside surface of deflector tube 116 along the axial length thereof and terminate at their downstream end in a plane that is coincidental with the end wall 122 of deflector tube 116. In this last embodiment the swirl vanes 124 formed on the outside of the deflector tube 116 are, in the same manner as the embodiment shown in FIGS. 5 and 6, positioned at an angle with respect to the longitudinal axis of deflector tube 116 that is opposite to the angle at which inner vanes are positioned with respect longitudinal axis of deflector tube 116.

When the ends of swirl vanes 86 are angled rearwardly with respect to the direction of fluid flow, as is shown in FIGS. 5 and 6, the buildup of hot spots and soot thereon will be minimized. It will be appreciated that excessive soot would change the flow pattern and is therefore undesirable because the heat range would be unpredictable. Depending on the fuel used and the operating conditions encountered more or less soot build-up will occur. Accordingly, the downstream end of swirl vanes 104 may only be partially angled, such as is shown in FIGS. 7 and 8 or the downstream end of swirl vanes 118, may not be angled at all, as is shown in FIGS. 9 and 10.

With the foregoing embodiments and discussion in mind, a detailed exposition of the invention will now be made with emphasis upon the actual flow paths of the atomized fuel, the pressurized air, and the fuel/air mixture.

Figure 11:
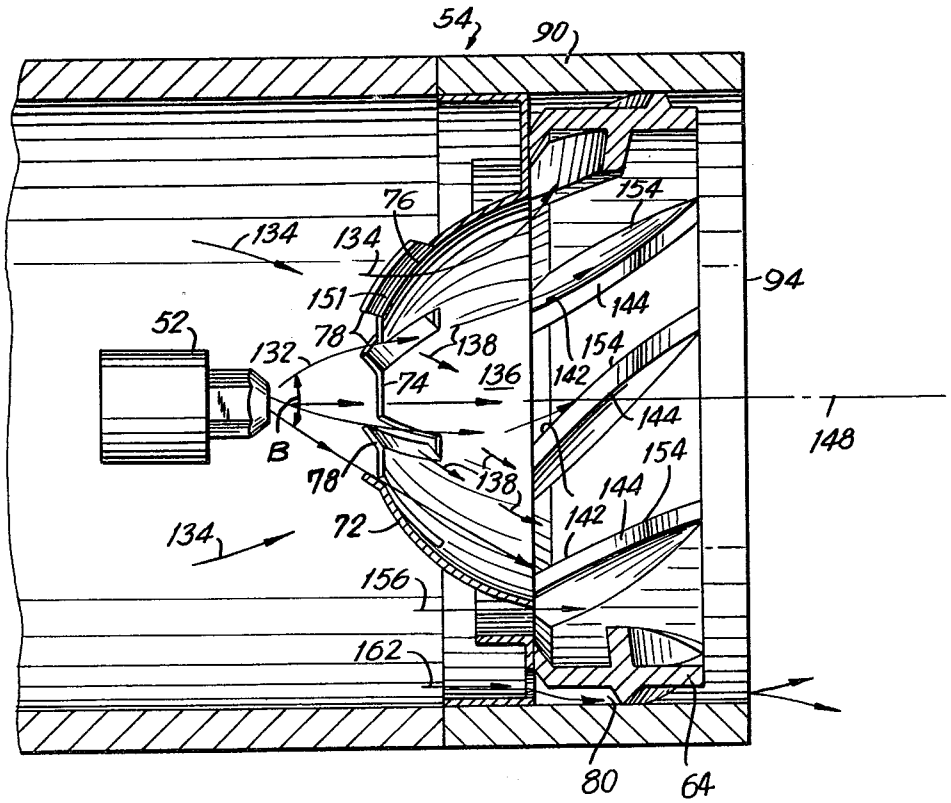
FIG. 11 is a fragmentary, partially sectional view schematically illustrating the primary, secondary, and tertiary air flows along with the atomized fuel flow.

Attention is directed to FIG. 11, which is a sectional elevational view similar to that of FIG. 4 with the addition of fuel nozzle head 52. Atomized fuel emerging from fuel nozzle head 52 is indicated by arrows designated numeral 132. Pressurized primary air surrounding nozzle head 52 is indicated by arrows designated by reference numeral 134. Primary air 134 acts to mix with atomized fuel 132 downstream of swirl vanes 78 that extend outwardly from dome-shaped portion 72 of flame retention head 54. Atomized fuel 132 and primary air 134 pass through slots 76, which extend through upstream end portion of flame retention head 54 specifically at the dome end of dome-shaped portion 72 in a radial configuration around a central circular passage, or primary air and fuel opening, 74. As shown in the preferred embodiment, seven slots 76 and seven adjoining swirl vanes 78 are shown. Flame retention head 54 forms a combustion chamber 136. Flame retention head 54 includes both dome-shaped member 72 and cylindrical deflector tube 64. Dome-shaped member 72 acts as an upstream flame wall where initial combustion occurs upon entry and mixing of primary air 132 and fuel 134. Atomized fuel 132 likewise passes into combustion chamber 136 through slots 76 and central opening 74 where it becomes mixed with primary air 134 and becomes vaporized to form a combustible fuel/air mixture shown by arrows designated by numeral 138. Fuel/air mixture 138 at this point is already swirling at high speed in a clockwise direction when viewed from the view of FIG. 12 taken from a downstream vantage point. This clockwise direction of swirl of fuel/air mixture 138 is created by swirl vanes 78, which are angled to direct atomized fuel 132 and primary air 134 in the clockwise direction as these enter combustion chamber 136 through slots 76. Fuel/air mixture 138 continues to swirl outwardly within dome-shaped portion 72 in a helical configuration as will be discussed in detail below. Ignition electrodes 56 extending outwardly from fuel nozzle head 52(electrode ends not shown) in a known manner act to ignite fuel/air mixture 138 initially, and by present flame after initial ignition. Upon combustion, the ignited fuel/air mixture 138 forms a primary rotating vortex of flame designated by numeral 140. Primary vortex 140, as shown in FIG. 16, rotates radially outwardly and is thrust downstream about longitudinal axis 148 of cylindrical deflector tube 64 by the force of primary air flow 134 from air slots 76 and passage 74 until the outwardly expanding primary vortex 140 strikes the upstream end cutting portions 142 of seven parallel equally distanced inner ramped secondary swirl vanes, or blades, 86, which are disposed about the inner surface 157 of cylindrical deflector tube 64. Blades 86 are compatible in construction and arrangement with blades 86 shown in FIG. 5. Certain inventive features of these blades set forth in added detail in FIGS. 13, 14, and 15 will be discussed. As shown in FIGS. 11 and 13, cutting portions 142 are located at the high end of blades 86 that extend between the upstream inner end plane 146 of cylindrical deflector tube 64 of flame retention head 54 and the downstream outer end plane 94 of tube 64. In the embodiment shown in FIGS. 5, 11, 12, 13, 14, and 15, the high end of ramp 144 is positioned at inner end plane 146.

In accordance with the present invention, blades 86 and in particular cutting portions 142 are approximately at right angles to the direction of the movement of primary flame vortex 140. As will be explained in detail, cutting portions 142 slice, or shear, away outer portions of the initial stage of primary vortex 140. To accomplish this shearing action efficiently, blades 86 with cutting portions 142 are disposed preferable at approximately right angles "A" as shown in FIG. 14 to the direction of the oncoming helical movement of primary vortex 140. Blades 86 are also angled across the direction of primary vortex 140, that is, at an angle "B" to the direction of longitudinal axis 148 of flame retention head 54 and combustion chamber 136. In the preferred embodiment of FIG. 14, angle B is approximately 45 degrees as will be further discussed in relation to FIG. 14. As will be discussed in relation to FIG. 14, blades 86 are angled toward the direction of rotation of primary flame vortex 140 with side walls 154 of blades 86 that face the movement of primary flame vortex 140 in particular disposed at an angle "C" with the radius 152 of cylindrical deflector tube 64 as shown in FIG. 15. Angle "C" is preferably approximately 22½ degrees in the preferred embodiment. Cutting edges 150 formed between ramped top walls 144 and side walls 154 intercept and shear away the outer portions of primary vortex 140, as will be explained.

The preferred embodiment of FIG. 11 also shows atomized fuel 132 being ejected from nozzle head 52 in a counterclockwise direction viewed from downstream as will be discussed with reference to FIG. 12. Swirl vanes 78 extend radially from central opening 74 and are disposed outward from the outer surfaces of dome-shaped member 72 towards head 52. Vanes 78 have inner surfaces 151 that adjoin slots 76 that also extend radially from central opening 74 and an opposed outer surface 153. Vanes 78 are disposed at an angle with slots 76 so as to direct primary air 134 in a helical clockwise direction, as viewed from downstream, towards inner walls 157 of combustion chamber 136, inner walls 157 being also dome-shaped at dome-shaped member 72. The helical clockwise direction of primary air 134 attains a high helical velocity and draws with it both the primary air 134 and fuel 132 that enters combustion chamber 136 through central opening 74. In addition, a portion of counterclockwise swirling fuel 132 strikes against outer surfaces 153 rather than inner surfaces 151 and so is prevented from being guided into combustion chamber 136 directly through slots 76 via vanes 78 but rather that portion of counterclockwise rotating fuel 132 that strikes outer surfaces 153 is drawn into combustion chamber 136 through slots 76 by reason of the vacuum created by swirling primary air 134 and swirling fuel/air mixture 138, which are being swirled clockwise in tne combustion chamber.

Also shown in FIG. 11 are the flows of secondary air which is schematically indicated as arrows designated by reference numeral 156. As generally indicated previously, secondary air 156, like primary air 134, is pressurized by air blower 48 and enters combustion chamber 136 around the outer perpihery of flame retention head 54 through arcuate slots 80. Upon entry of secondary air 156 into combustion chamber 136, secondary air 156 mixes under pressure with helically rotating sheared portions of primary flame vortex 140. These sheared portions are now swirling in a counterclocksise direction in a plurality of secondary flame vortexes 158, each of which are formed in equally sized and spaced channels 160 formed between blades 86. The entry of secondary air 156 serves to add to the combustibility of secondary vortexes 158. When secondary air 156 passes through slots 80 it thereupon enters the upstream end of channels 160 which are disposed at an angle to the longitudinal axis 148 of flame retention head 54 and of cylindrical deflector tube 64.

A tertiary air flow also under pressure from air blower 48 shown as arrows designated by reference numerals 162 passes between third set of swirl vanes 100 which in turn are disposed between deflector tube 64 and outer tubular member 90. A detailed discussion of tertiary air 162 will follow later.

FIG. 12 illustrates a view of flame retention head 54 shown in FIG. 11 viewed from downstream of head 54 looking upstream. Outer tubular sleeve member 90 encasing cylindrical deflector tube 64 with four equally spaced outer channels 164 is shown. Also illustrated are the seven second swirl vanes, or blades, 86 extending from the inner surface 157 of deflector tube 64 and forming inner channels 160. Shown at the center of combustion chamber 136 is primary opening 74 formed in the center of dome-shaped member 72 and first swirl vaned 78 on member 72 with adjacent slots 76. Also shown in FIG. 12 are schematic indications of the air flows of fuel/air mixture 138 and primary, secondary, and tertiary air flows 134, 156, and 162, along with secondary vortexes 158.

In particular, fuel/air mixture 138 is shown entering combustion chamber 136 through slots 76 in a clockwise direction as directed by swirl vanes 78. At the same time primary air 134, indicated by head-on arrows, enters combustion chambers 136 through primary opening 74, and atomized fuel 132 simultaneously enters the combustion chamber through primary opening 74 in a counterclockwise direction, since the atomized fuel 132 is ejected from atomizing nozzle 52 in a counterclockwise direction. As will be explained later, the total fuel-/air mixture is carried by the pressurized air after entering slots 76 as directed by swirl vanes 78 which action overcomes the lesser force of the counterclockwise rotation of atomized fuel 132 entering combustion chamber 136 through opening 74 so that primary flame vortex 140, which is not indicated in FIG. 12, rotates in a clockwise motion. It is noted that the counterclockwise rotation of atomized fuel 132 is in fact a helical counterclockwise motion moving downstream as ejected from nozzle 52. Likewise the clockwise rotation of atomized fuel 132 and primary air 134 in combustion chamber 138 through slots 76 as directed by vanes 78 is a helical clockwise motion.

Secondary air flows 156 are schematically indicated passing through air passages 80 by head-on arrows, one at each channel 148, into combustion chamber 136 where the flows join with secondary flame vortexes 158 that are formed in each channel 160.

In accordance with the present invention, the outer portions 166 of primary central flame vortex 140 are schematically illustrated as arrows striking cutting portions 142 of blades 86 at right angles. These outer portions 166 are sheared away from central primary vortex 140 and are turned, or swept, backwards upon themselves at slanted walls 154 of blades 86 in a rotational direction opposite to the clockwise helical motion of primary vortex 140. That is, each secondary vortex 158 each forms a counterclockwise helical motion moving downstream. One secondary vortex is formed in each channel 160 between blades 86. It is possible to increase or decrease the number of blades and channels within the spirit of the present invention.

In accordance with the present invention, a close-up perspective view of cutting portion 142 of blade 86 is shown in FIGS. 12*a* and 12*b*. In particular, an outer portion 166 of primary flame vortex 140 strikes against the top upstream side top cutting edge 150 of blade 86. Top cutting edge is spaced radially inward from circular bevel 88 at upstream end 92 of deflector tube 64 and from dome-shaped member 72. This spacing is indicated in FIG. 12*b* as space 186. Secondary vortex 158 is formed from outer portion 166 being sliced off and spun in an opposite rotational direction from and radially outwardly from primary vortex 140, as seen in FIG. 16.

FIGS. 13 and 14 illustrate the direction of secondary vortexes 158 after they have been joined by secondary air 156. FIG. 13 illustrates the counterclockwise helical motion of atomized fuel 132 as it emerges from fuel atomizing nozzle 52 en route to flame retention head 54, with dome portion 72 indicated in phantom lines. Primary air 134 and secondary air 156 are shown approaching dome member 72. Outer portions 166 of primary central flame vortex 140 (not shown in FIG. 13) are shown striking cutting portions 142 of blades 86 at right angles. The angle of movement of fuel/air mixture 138 within primary vortex 140 is helical, as indicated in FIG. 16. During the initial stages of combustion in combustion chamber 136, primary flame vortex 140 expands helically outwardly and forward, indicated as first stage 168 of primary vortex most clearly seen in the simplified rendering of FIG. 16. When outer portions 166 of first stage primary vortex 168 strike cutting portions 142 of blades 86, outer portions 166 are sheared away from first stage 168 to form reduced second stage 169 of primary flame vortex 140 and simultaneously a plurality of secondary flame vortexes 158, one of which is shown in FIG. 16. Secondary vortexes 158 are helical in configuration and move at an angle relative to the direction of primary vortex 140 in blade channels 160. Primary vortex 140, specifically second stage 169, in turn moves helically forward about the longitudinal axis 148 of flame retention head 54 and cylindrical tube member 64. FIG. 14 shows fuel/air mixture of outer portion 166 of primary vortex 140 striking cutting portions 142 of blades 86 at an angle "A", which as stated previously is approximately 90 degrees. In accordance with the present invention, it is the initial act of shearing that accomplishes the effect of creating the seven secondary helical vortexes 158. It is possible to incease or decrease the number of secondary vortexes 158 by increasing or decreasing the number of equally spaced blades 86 thus increasing or decreasing the number of channels 160 in which secondary vortexes 158 are contained and directed within the spirit of the invention.

As shown in FIG. 15, each blade 86 is preferably positioned at an inward leaning angle "B" that leans into the direction of the oncoming swirl of the outer portions 166 of primary vortex 140; the angle "C" being measured between the radius line 152 of cylindrical deflector tube 64 as measured to the cylindrical inner surface 157 of tube 64 and the slanted facing wall 154 of blade 86 that extends from cutting edge 150. Angle C is preferably approximately 22½ degrees.

FIG. 16 indicates in a simplified schematic perspective view primary vortex 140 with only a single secondary vortex 158 of the seven secondary vortexes 158 created when the shearing of the outer portion 166 from the first stage 168 of primary vortex 140 occurs at cutting portion 142. The helical configurations of both the primary and secondary flame vortexes 140 and 158 are shown, with primary vortex 140 having a clockwise rotation when viewed from upstream and secondary vortex 158 counterclockwise.

It is to be particularly noted that primary vortex 140 and each secondary vortex 158 have three forces: first, a circular rotational force; second, a forward helical configured force; and third, an overall longitudinal thrust force that is parallel to the longitudinal axis 148 of flame retention head 64. Thus, in FIG. 16, the longitudinal thrust 170 of primary vortex 140, which is configured around longitudinal axis 148, and longitudinal thrust 172 of secondary vortex 158 are parallel one to another. Longitudinal thrust 172 is created by the basic forward or longitudinal thrust of primary and secondary air 134 and 156 while its helical configuration is created by the counterforces of each channel 160 and primary vortex 140. The helical configuration of secondary vortexes 158 are slightly shewed in order to accomodate their longitudinal thrusts 172. Primary vortex 140 and secondary vortex 158 are shown in FIG. 16 as terminating at downstream end face 94, but in fact both vortexes will extend beyond end face 94, but with diminishing force and continual loss of helical configuration in the usual manner of a jet flame.

A schematic illustration of primary vortex 140 and secondary vortexes 158 as viewed in cross-section at any plane downstream of inner face 146 viewed from downstream of the cross-section is shown in FIG. 17. Second stage 169 of primary flame vortex 140 is shown in its clockwise rotation surrounded by seven secondary flame vortexes 158 rotating counterclockwise. It is to be particularly noted that there is a "gearing" or "meshing" of the secondary vortexes with the primary vortex although the actual rotational directions of the vortexes are in opposition. Also shown in FIG. 17 are flame vortexes that occur in the hiatuses between primary vortex 140 and secondary vortexes 158. Seven inner free flame vortexes 174 are formed in the spaces between primary vortex 140 and secondary vortexes 158. In addition, seven outer free vortexes 176 are formed between secondary vortexes 158 and deflector tube 64 of flame retention head 54. The free vortexes are indicated in general but in fact outer free vortexes 176 in particular will be more pronounced toward downstream end face 94 of deflector tube 64 than toward upstream end face 146 where blades 86 are more prominent. The direction of rotation of both inner and outer free vortexes 174 and 176 are clockwise and thus both mesh with the counterclock rotation of secondary vortexes 158.

Attention is now directed to tertiary air flow 162 and third set of swirl vanes 100. As shown in the preferred embodiment of FIGS. 5, 12, and 13, four swirl vanes 100 are shown connected to the outer surface of deflector tube 64 flame retention head 54 at an angle so as to direct tertiary air flow 162 in outer channels 164 in a counterclockwise direction in reinforcement of the counterclockwise rotation of helical flow of secondary flame vortexes 158. Tertiary air flow 162 adds to the already high temperature attained at the outer portion 166 of primary vortex by secondary vortexes 158. This added heat is attained since cooler fuel/air mixtures or gases are thrown to the periphery of primary vortex 140. When secondary vortexes 158 with secondary air 156 are achieved, the outer walls of flame retention head 54 are heated to a higher temperature than would occur otherwise. These heated walls include both the walls of cylindrical tube member 64 and tubular sleeve member 90 mounted around tube member 64, the former providing the outer portions of outer channels 164 through which tertiary air 162 is forced. Before tertiary air 162 is injected into secondary vortexes 158 it has been preheated to a substantially high temperature. Upon its mixing with secondary vortexes 158, it acts as a preheated burning medium. The preheating of tertiary air 162 results in the avoidance of incomplete combustion and resultant formation and deposit of ash. Injection of tertiary air 162 is optional and is advantageous where very high temperatures are desirable.

The alternate embodiments shown in FIG. 7 and 9 will now be briefly discussed.

FIG. 7 shows blades 104 that ramp upwardly from inner upstream end 112 to downstream end 108 with downstream cutting portions 180, which is analagous to cutting portions 142 of FIG. 5, being at downstream end 108 rather than at the upstream end 146 as in FIG. 5. FIG. 7 also shows third swirl vanes 114 that direct tertiary air flow 162 clockwise rather than counterclockwise as shown in FIG. 5, with tertiary air flow 162 cutting against the direction of rotation of secondary vortexes 158 with the result that the distance the total flame would extend from flame retention head 64 would be shortened.

FIG. 9 illustrates unramped blades 118 having upstream cutting portions 182 similar to cutting portions 142 shown in FIG. 12*a*. Unramped blades 118, however, remain equally spaced from deflector tube 64 between upstream end 119 and downstream end 120. Third swirl vanes 124 direct tertiary air 162 into secondary vortexes 158 in a counterclockwise direction.

It should be understood that while certain combinations of angles of inner and outer swirl vanes and certain end face configurations have been illustrated with respect to specific embodiments, the present invention is not so limited and various other combinations of structure may be employed.

There has been disclosed herebefore the best embodiments of the invention presently contemplated. However it is to be understood that various changes and modifications may be made by those skilled in the art without departing from the spirit of the invention.

What is claimed is:

1. Combustion apparatus including ignition means, a source of pressurized air, and a source of pressurized atomized fuel, said apparatus comprising:

a flame retention head forming a cylindrical combustion chamber having an upstream end and a downstream end and a longitudinal axis extending between said upstream and downstream ends, first passage means including first deflector means for passing a first portion of said pressurized air and said pressurized fuel into said upstream end of said combustion chamber, said first deflector means being for directing said air and said fuel in a first rotational direction into a fuel/air mixture of helical configuration adopted to being ignited into a primary flame vortex about said longitudinal axis, second deflector means mounted about the inner surface of said combustion chamber downstream of said first deflector means, said second deflector means being for shearing away the outer portions of said primary flame vortex and directing said outer portions into a plurality of secondary flame vortexes of helical configurations directed in second rotational directions opposed to said first rotational direction and disposed about said primary flame vortex, and second passage means formed in said flame retention head disposed in association with said second deflector means and being for passing a second portion of said pressurized air into said combustion chamber into mixture with said plurality of said secondary flame vortexes.

2. Combustion apparatus according to claim 1 further including a plurality of third passage means formed with said flame retention head for passing a third portion of said pressurized air into said combustion chamber downstream of said second passage means into mixing contact with said plurality of said secondary flame vortexes.

3. Combustion apparatus according to claim 2, wherein said third passage means directs said portion of pressurized air into said first rotational direction.

4. Combustion apparatus according to claim 2, wherein said third passage means directs said portion of pressurized air into said second rotational direction.

5. Combustion apparatus according to claim 3, wherein said second deflector means includes a plurality of approximately parallel and equally spaced blades disposed about the inner surface of said flame retention head forming channels between said blades, said secondary flame vortexes being directed in said channels.

6. Combustion apparatus according to claim 5, wherein said blades are disposed approximately perpendicular to said first rotational direction.

7. Combustion apparatus according to claim 6, wherein said blades are ramped between a high end spaced radially inwardly from said inner surface of said flame retention head and an opposed end spaced proximate to said inner surface, wherein said high ends are in cutting contact with said outer portions of said primary flame vortex.

8. Combustion apparatus according to claim 7, wherein said high ends are disposed proximate to said second passage means remote from said downstream end of said cylindrical combustion chamber.

9. Combustion apparatus according to claim 7, wherein said high ends are disposed proximate to said downstream end of said cylindrical combustion chamber.

10. Combustion apparatus according to claim 6, wherein said blades are spaced radially inwardly from said inner surface of said flame retention head between said upstream and said downstream ends of said flame retention head.

11. Combustion apparatus according to claim 7, wherein said first deflector means includes a plurality of vanes disposed adjoining a plurality of slots, said vanes being disposed to direct said first portion of said pressurized air through said slots in said first rotational direction.

12. Combustion apparatus according to claim 11, wherein said blades of said second deflector means are disposed at an angle relative to said longitudinal axis of approximately 90 degrees to said first rotational direction.

13. Combustion apparatus according to claim 12, wherein said blades of said second deflector means are disposed at an angle of approximately 45 degrees relative to said longitudinal axis.

14. Combustion apparatus according to claim 12, wherein said blades include a side surface facing said first rotational direction of said primary flame vortex, said side surface being disposed at an acute angle with the radius of said cylindrical combustion chamber towards said first rotational direction.

15. Combustion apparatus according to claim 14, wherein said acute angle is approximately 22½ degrees.

16. Combustion apparatus according to claim 15, wherein said flame retention head includes a dome-shaped portion positioned at said upstream end and said first deflector means, said plurality of vanes being radially positioned on and extending outward from said dome-shaped portion, said first passage means also including said slots forward through said dome-shaped portion adjoining said vanes, said vanes being radially oriented and extending outwardly from dome-shaped portion and being adapted to direct a part of said first portion of air helically through said slots into said combustion chamber so that said first portion of air is rotationally directed within said dome-shaped portion in expanding helical rotation in said first rotational direction wherein said air is mixed with said fuel into said fuel/air mixture and ignites into said primary flame vortex wherein said primary flame vortex comes into helical rotation contact in said first rotational direction approximately perpendicular to said blades of said second deflector means.

17. Combustion apparatus according to claim 16, wherein said vanes include opposed inner and outer faces, said vanes extending outwardly from said dome-shaped portion towards said source of pressurized fuel, said source of pressurized fuel being adapted to eject said pressurized fuel in said second rotational direction wherein said pressurized fuel strikes said outer faces of said vanes.

18. Combustion apparatus according to claim 17, wherein said dome-shaped portion has a cylindrical base, said blades being positioned between said cylindrical base and said downstream end of said flame retention head.

* * * * *